US008579049B2

(12) United States Patent
Kinsella

(10) Patent No.: US 8,579,049 B2
(45) Date of Patent: Nov. 12, 2013

(54) DRILLING SYSTEM FOR ENHANCED CORING AND METHOD

(75) Inventor: Douglas Kinsella, Edmonton (CA)

(73) Assignee: Corpro Technologies Canada Ltd., Calgary (CA)

( * ) Notice: Subject to any disclaimer, the term of this patent is extended or adjusted under 35 U.S.C. 154(b) by 327 days.

(21) Appl. No.: 12/853,481

(22) Filed: Aug. 10, 2010

(65) Prior Publication Data

US 2012/0037427 A1 Feb. 16, 2012

(51) Int. Cl.
*E21B 17/042* (2006.01)
*E21B 25/00* (2006.01)

(52) U.S. Cl.
USPC ..... 175/320; 175/20; 175/58; 175/244; 175/249; 175/403

(58) Field of Classification Search
USPC ..... 175/20, 58, 320, 244, 249, 403
See application file for complete search history.

(56) References Cited

U.S. PATENT DOCUMENTS 3,786,878 A * 1/1974 Chapman ..... 175/320
3,871,486 A * 3/1975 Curington et al. ..... 175/60
3,926,265 A * 12/1975 Bouyoucos ..... 175/320
4,121,862 A * 10/1978 Greer ..... 285/333
4,156,469 A * 5/1979 Laskey ..... 175/58
4,273,159 A * 6/1981 Bolton et al. ..... 175/325.1
4,296,973 A * 10/1981 Hartwell ..... 175/325.4
4,771,811 A * 9/1988 DeCell et al. ..... 175/320
4,981,183 A * 1/1991 Tibbitts ..... 175/403
4,997,048 A * 3/1991 Isom ..... 175/323
5,148,876 A * 9/1992 Wilson ..... 175/325.3
5,184,495 A * 2/1993 Chunn et al. ..... 72/318
5,206,505 A * 4/1993 Sprunt ..... 175/249
5,286,069 A 2/1994 Wilson
H1329 H 7/1994 Bailey et al.
5,351,765 A * 10/1994 Ormsby ..... 175/58
5,419,595 A 5/1995 Yamamoto et al.
5,788,401 A * 8/1998 Drenth ..... 403/343
5,853,199 A * 12/1998 Wilson ..... 175/325.1
6,006,844 A * 12/1999 Van Puymbroeck et al. ... 175/58
RE37,167 E * 5/2001 Wilson ..... 175/325.1
6,295,867 B1 10/2001 Mahaffey
6,659,204 B2 12/2003 Aumann et al.
6,736,224 B2 5/2004 Kinsella
6,945,338 B1 9/2005 Defourny et al.
7,814,996 B2 * 10/2010 Indrupskiy et al. ..... 175/323
2003/0106717 A1 6/2003 Kinsella (Continued)

OTHER PUBLICATIONS

"Boart Longyear V-Wall Overview", 2640 W. 1700 South, Salt lake City, UT, 84104; www.boartlongyear.com.

(Continued)

*Primary Examiner* — Frederick L Lagman
(74) *Attorney, Agent, or Firm* — Kenneth L. Nash

(57) ABSTRACT

A drill string assembly is required that has the capability of operating in well bores that range in hole size from seven to eight inches in diameter. The assembly is used to obtain a large core sample size that is equal to three and one-half inches in diameter and up to ninety feet in length in a single core run. This assembly will be operated with a drill string (i.e. drill pipe) that is capable of being used on standard drilling rigs, which may be used to handle API style drill pipe to conduct coring/drilling operations. The coring tool is comprised of an inner barrel for receiving the core sample.

20 Claims, 5 Drawing Sheets

(56) References Cited

U.S. PATENT DOCUMENTS

| | | | | |
|---|---|---|---|---|
| 2005/0189147 | A1 | 9/2005 | Williamson et al. | |
| 2006/0225926 | A1 * | 10/2006 | Madhavan et al. | 175/320 |
| 2009/0114447 | A1 | 5/2009 | Reid, Jr. et al. | |
| 2009/0255679 | A1 | 10/2009 | Bartette et al. | |
| 2010/0096188 | A1 | 4/2010 | Buske | |

OTHER PUBLICATIONS

Drumheller, Douglas S., Sandia Report, "Coring in Deep Hardrock Formations", SAND88-1018-UC-253, Unlimited Release, Aug. 1988.

* cited by examiner

DRILLING SYSTEM FOR ENHANCED CORING AND METHOD

BACKGROUND OF THE INVENTION

1. Field of the Invention

The present invention relates generally to drilling systems and, in one particular embodiment, to a drilling system, which may be utilized with an enhanced coring system to obtain 3.5 inch diameter cores in a single pass, which are up to 90 feet long.

2. Description of the Prior Art

There has been a long felt need in the oil and gas industry to be able to provide ninety foot long cores of three and one-half inches, preferably in a single pass. However, for decades, prior art methods have failed to provide this capability. While this capability would be desirable in any size wellbore, this capability would not be expected to be developed for drilling in relatively smaller well bores that range in hole size from seven and three-quarter inches to eight inches in size.

U.S. Pat. No. 6,736,224, issued May 18, 2004, to the present inventor, which is hereby incorporated herein by reference in its entirety, provides a drilling system that teaches how to obtain relatively large diameter cores while drilling/coring small diameter (approximately 6 inch), shallow (less than a few thousand feet) boreholes. However, while the system is now commonly used to obtain relatively large diameter cores in relatively small diameter, shallow wells, the system is limited to shallow holes of a few thousand feet. As well, for this system, the holes must be relatively vertical. Finally, the system is not capable of producing ninety foot long cores of three and one-half inches.

In well bores that are at greater depths (i.e, greater than 7,000 feet) with formations of a higher compressive strength, there remains a significant risk of core loss prior to retrieval. Larger and longer cores could be utilized to improve analytical test results and obtain full samples upon retrieval. For example, having a core diameter of a larger size could improve lost gas analysis tests by creating a larger mass for testing formation fluid content by having a larger mass for analysis.

Various limitations presently prevent obtaining larger and longer diameter cores (i.e., equal to three and one-half inches in diameter and up to ninety feet in length) when drilling well bores that range in hole size from seven and three-quarter inches to eight inches in size. Casing, which was used in shallow wells to obtain large diameter cores, is not practical at greater depths. Presently used API drill pipe for this diameter hole does not have sufficient ID to permit larger diameter cores. Moreover, there was previously no mechanism for creating suitable pipe to handle the coring forces dynamics, which at greater depths, also require a high torque connection and high tensile rating.

Historically when attempting to extract wire line core samples at depths greater than 7,000 ft., an industry available API drill string was utilized in order to achieve such depths. However, in order to maintain an appropriate operating tensile and torsional strength for the drill pipe in a hole size of seven and three quarters to eight inches, the maximum core size diameter achievable using an API drill string is only three inches.

In order to achieve a larger core diameter size (greater than three inches), the internal diameter of standard API, proprietary, or market available drill pipe would be required. This in turn would weaken the pipe and therefore eliminate the pipe as a solution from the very problem it was intended to solve.

The above cited prior art does not disclose suitable solutions to the above discussed problems. As a result, a need remains for a system capable of obtaining larger diameter core samples (equal to three and one-half inches) as well as other drilling operations.

Consequently, those skilled in the art will appreciate the present invention that addresses the above and other problems.

SUMMARY OF THE INVENTION

An objective of the present invention is to provide an improved coring and/or drilling assembly and method.

Another objective of the invention is to provide a coring system that is capable of obtaining larger diameter cores in well bores that exceed 7,000 ft in depth.

These and other objectives, features, and advantages of the present invention will become apparent from the drawings, the description given herein, and the appended claims. However, it will be understood that the above-listed objectives and/or advantages of the invention are intended only as an aid in quickly understanding aspects of the invention, are not intended to limit the invention in anyway, and therefore, do not form a comprehensive or restrictive list of objectives, and/or features, and/or advantages.

Accordingly, the invention comprises, in one of many possible embodiments thereof, an assembly operable for drilling and/or coring a wellbore and/or other operations. The assembly may comprise one or more elements such as, for instance, a drill pipe having a tubular outer diameter and an upset portion of the drill pipe tubular extending radially outwardly and/or inwardly with respect to the tubular outer diameter. In one possible embodiment, the upset portion has an outer diameter less than or equal to six and nine-sixteenth inches for drilling in a seven and seven-eighths borehole, but may be larger for larger boreholes. In one embodiment, the drill pipe may preferably have an inner diameter of at least four and three-eighths inches or may have an inner diameter of at least four and one-half inches. A threaded pin connection is provided for the drill pipe adjacent the upset portion, wherein the threaded pin connection may preferably have an axial length of at least four inches.

The assembly may comprise a tubular outer diameter in the range of five and one-half inches. The assembly may further comprise a coring tool insertable into the drill pipe tubular, and an inner core barrel of the coring tool for receiving a core sample diameter equal to three and one-half inches.

In another embodiment, the assembly may comprise a plurality of the drill pipe tubulars threadably connected together to form a drilling string. The pin connector is sufficiently thick to provide the drill string with a maximum torque value without damaging the drilling string greater than 48,000 ft-lbs. The tube of the drill string is sufficiently thick to provide a maximum tensile value without damaging the drill string greater than 786,000 pounds.

A method for a coring system in accord with the present invention comprises one or more steps, such as, for instance, and providing, in one possible embodiment, a plurality of drill pipe tubulars having a minimum inner diameter equal to or greater than four and one-half inches. In another embodiment, the minimum inner diameter is equal to or greater than four and three-eighths inches. In one possible embodiment, other steps may comprise providing an upset on the drill pipe having a maximum outer diameter greater than or equal to six and three-eighths inches, and/or providing a coring tool having a core barrel for receiving a core with an outer diameter equal to three and one-half inches up to ninety feet in length.

The method may further comprise providing a threaded pin adjacent the upset having a maximum axial length of four inches. The method may further comprise providing that the barrel axial length is greater than thirty feet and at least up to ninety feet in length. The method may further comprise providing that the thickness of the upsets are such that the drill string has a maximum torque value without damaging the drill string of greater than 48,000 foot pounds. The method may further comprise providing that the thickness of the tube portion of the pipes in the drilling string are such that the drilling string has a maximum tensile value without damaging the drilling string of greater than 786,000 pounds.

In another embodiment an assembly is provided that is operable for wireline retrievable coring and/or drilling and/or other operations in a wellbore between seven and eight inches in diameter comprising one or more elements such as, for instance, and plurality of drill pipe tubulars threadably connectable together wherein each drill pipe tubular has a tubular outer diameter. In one possible embodiment, an upset may be provided for each of the drill pipe tubulars having a maximum outer diameter greater than or equal to six and three-eighths inches, and/or each drill pipe tubular having an inner diameter equal to four and one-half inches.

The assembly may further comprise a threaded pin connection wherein the axial length of the pin may be four inches. The assembly may further comprise a coring tool with an inner coring barrel for receiving a core having an inner diameter for receiving a core equal to three and one-half inches in diameter.

This summary is not intended to be a limitation with respect to the features of the invention as claimed, and this and other objects can be more readily observed and understood in the detailed description of the preferred embodiment and in the claims.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

Figure 1:
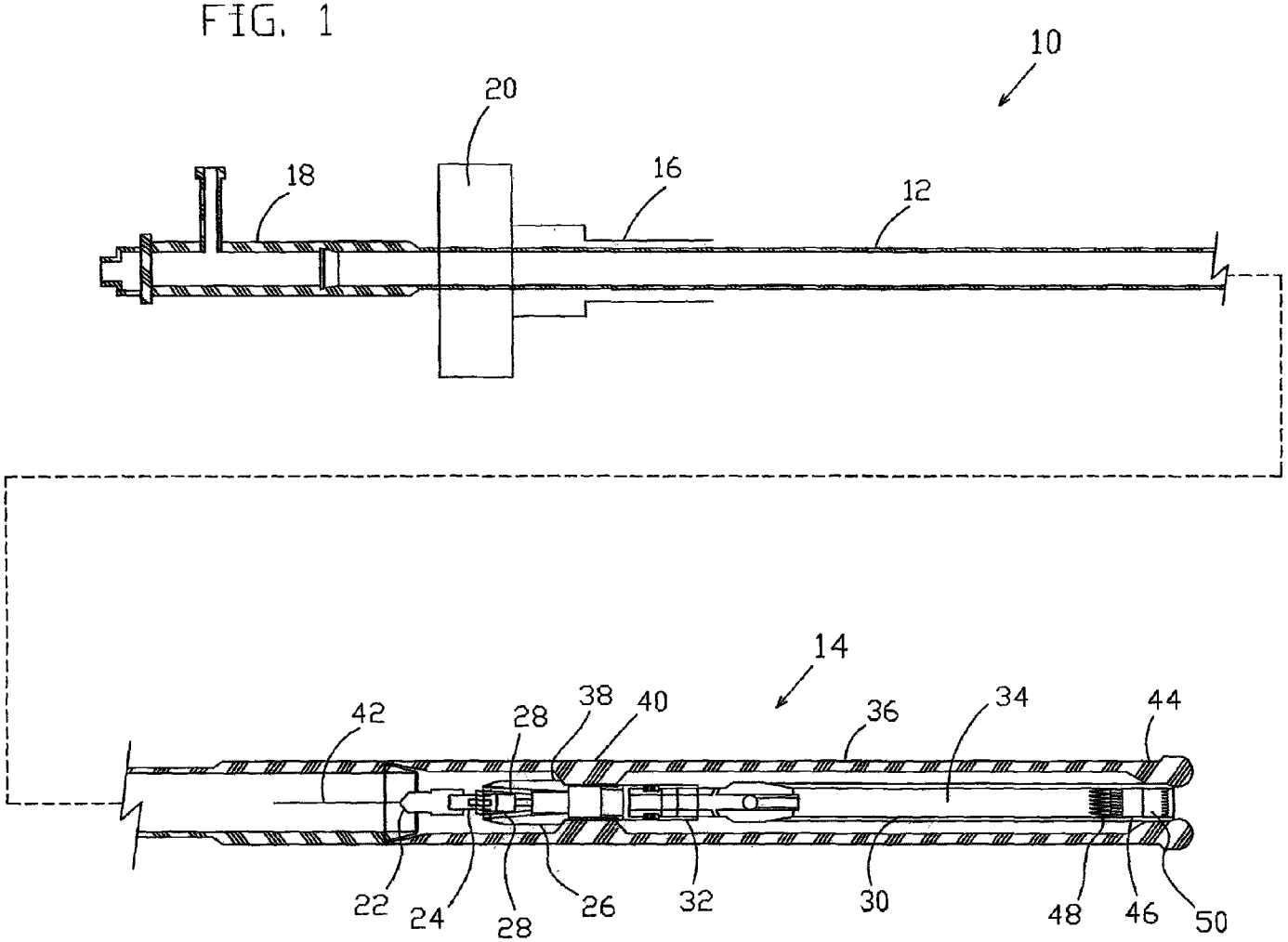
FIG. 1 is an elevational view, in cross-section, showing a basic drilling and wireline retrievable coring tool system which may comprise modifications as described herein and utilized with the present invention.

Referring now to the drawings, and, more particularly to FIG. 1, a coring/drilling/wellbore assembly 10 is shown, which when modified in accord with the present invention, can be utilized for obtaining large diameter cores, e.g., cores with a three and one-half inch diameter, in holes less than eight inches in size and over seven thousand feet deep. Cores of this size may be captured in lengths of up to ninety feet or so with a single run.

The system makes use of drill pipe string 12, which may comprise many threaded drill pipes, and in accord with the present invention, a larger diameter inner coring tool assembly 14 may be used. The well bore 16 may typically be less than eight inches in diameter, such as seven and three-quarter to eight inches in size.

Drilling fluid may be captured in the mud tanks when using flow diverter 18, which is positioned above rotary table 20 when retrieving coring tool assembly 14 as discussed in more detail subsequently. Rotary table 20 or other suitable means such as a top drive or kelly drive, may be utilized to rotate drill string 12 for coring and/or drilling operations. Drill pipe string 12 comprises a plurality of drill pipes, such as drill pipes 100A or 100B of FIG. 4A or 4B, threadably secured together.

Coring tool assembly 14 may be of various constructions, but a presently preferred core barrel of coring tool assembly 14 is as discussed below in accord with FIG. 5. Coring tool assembly 14 may preferably be wireline retrievable. The wireline, such as wireline 42, may be connected by means of rope socket 22.

Various types of latching mechanisms to hold the coring tool 14 in place during coring and/or drilling may be used, such as mechanical latches and/or hydrostatic pressure. In accord with a presently preferred embodiment, bypass head assembly 24 and tool seal seat 26 with flow passages 28 is designed to create a pressure differential at the top of the coring tool 14 with sufficient downward thrust to hold coring tool 14 in position while coring. The size of flow passages 28 may be determined by the strength of the formation being cored. Core barrel assembly 30 is rotatably connected to swivel assembly 32 to the tool seal seat 26. In this way, core barrel 30 may remain stationary to keep the core that is received into interior 34 of inner core barrel 30 from twisting off while outer tube 36 rotates with and effectively is part of the drill pipe string 12. Hydrostatic pressure forces tool seal seat 26 to engage shoulder 38 of outer pressure sub 40. Once tool seal seat 26 engages shoulder 38, a hydrostatic force is created and all or substantially all fluid flow goes through passages 28. The limited diameter of flow passages 28 creates a differential pressure across tool seal seat 26 that holds tool seal seat 26 in engagement with shoulder 38 during the coring operation.

During wireline retrieval of the core, bypass head assembly 24 opens when coring inner assembly 14 is moved through pipe string 12 by wireline 42. The outer diameter of the tool seal seat 28 is very close to the inner diameter of drill pipe 12, or more particularly to the connectors 112 and 114, shown in FIGS. 2, 3, 4A and 4B, as discussed hereinafter. Therefore, at the connectors, there is only a small clearance for the drilling fluid to pass by as inner coring tool assembly 14 is retrieved.

Figure 4A:
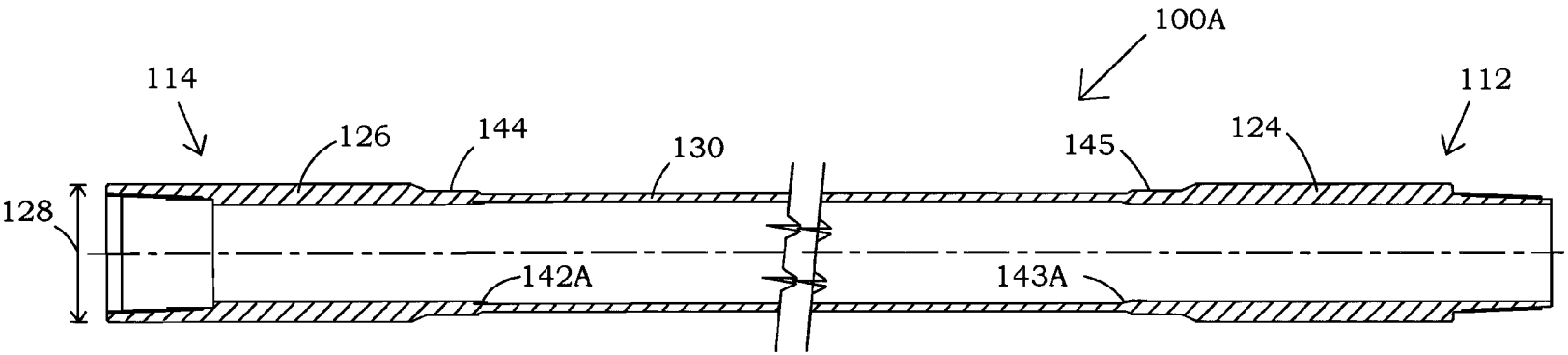
FIG. 4A is an elevational view, in cross-section, showing a drill string pipe with connectors comprising internal and external upsets where the connector meets with the tube in accord with one possible embodiment of the invention.
Figure 4B:
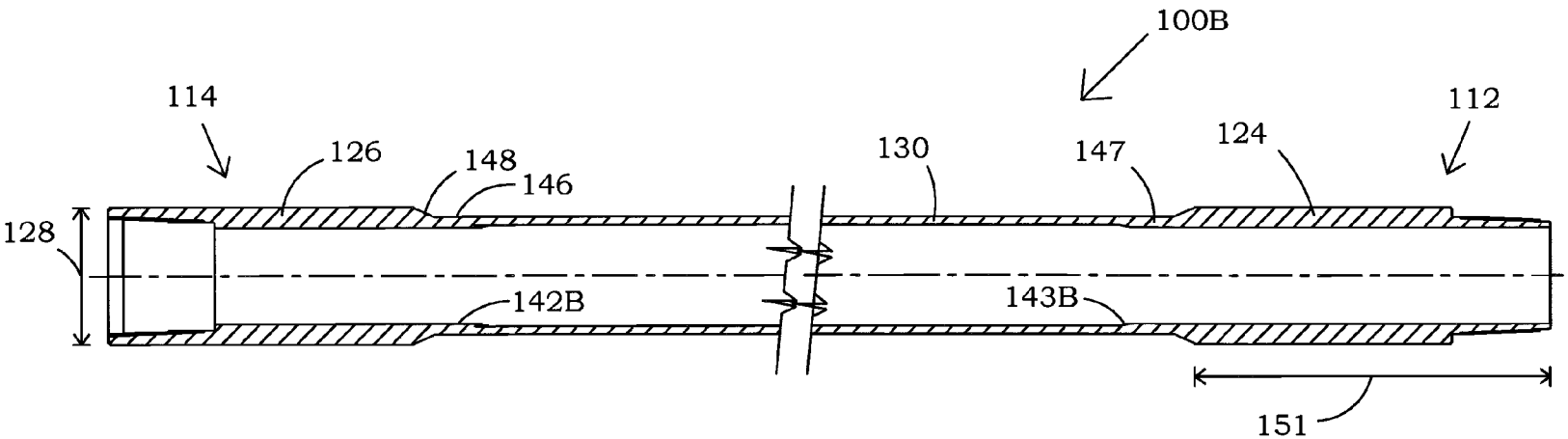
FIG. 4B is an elevational view, in cross-section, showing a drill string pipe with connectors comprising only an internal upset and no external upset where the connector meets with the tube in accord with one possible embodiment of the invention.

However, for center portion 130, shown in FIGS. 4A and 4B, there is substantial clearance to allow pulling of the ninety foot core barrel at speeds over one hundred and fifty feet per minute.

If the drilling fluid cannot easily flow past inner coring tool assembly 14, then the retrieval of coring tool 14 by wireline 42 must be slowed. Otherwise, excessive drilling fluid may be swabbed out of the drill pipe.

Swabbing creates two potential problems. Fluid removed from wellbore 16 creates the potential of lost well control. Normally, the well may be controlled by the hydrostatic pressure of the drilling fluid, but such control may be lost if excessive drilling fluid is swabbed from the well bore. Also, as fluid is swabbed, the pulling load on the wireline increases.

If the pressure should increase too much, the wireline connection may break. Typically, the wireline has a weak link or joint, which may typically be adjacent rope socket 22, which is designed to break to protect the wireline from being overly stressed.

In the present assembly, bypass head assembly 24 routes the fluid through the internal portion of the assembly and out the low pressure side thereof resulting in less than 1% of the drilling fluid being swabbed.

Core bit 44 may be of various types designed to cut the core and allow the core to enter upper shoe 46. In one embodiment, a retrievable pilot bit may be utilized. Basket catcher 48 and/or spring catcher 50 and/or other types of catchers hold the core inside inner core barrel 30 to prevent the core from dropping out. Inner core barrel 30 may have a length of up to at least ninety feet. The inner diameter of inner tube 30 may be sufficient to house a three and one-half inch core diameter.

Although a preferred core barrel is discussed in more detail hereinafter with respect to FIG. 5, in one possible embodiment, inner tube 30 may comprise split aluminum halves or solid aluminum liners that may be held together in one or more steel tubulars. In one embodiment, the inner barrel may be a thick walled solid aluminum tubular. Inner coring tool 14 in accord with the present invention is designed to cut a three and one-half inch diameter core, which may be up to ninety feet in length.

Referring now to FIG. 2, FIG. 3, FIG. 4A, and FIG. 4B, there is shown one embodiment of the invention, which provides for drill pipe 100A and 100B (see FIG. 4A and FIG. 4B) that may be utilized to create a drill pipe string with a high torsional strength (48,000 ft-lbs), a high tensile strength (786,000 lbs) and, in one presently preferred embodiment, with an internal diameter of four and one-half inches (4.5").

Figure 2:
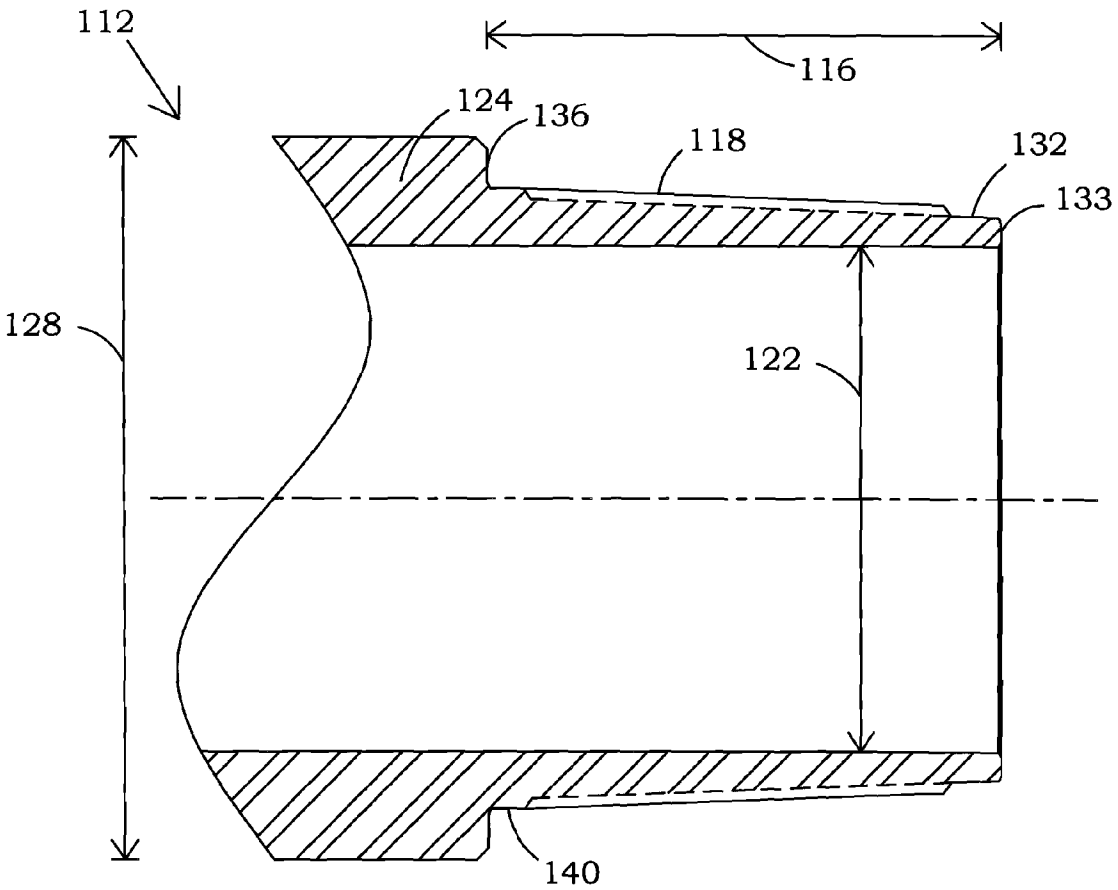
FIG. 2 is an elevational view, in cross-section, showing an enlarged end of a drill string pin connector with inner diameter, outer diameter, pin length and tapered threads in accord with one possible embodiment of the invention.
Figure 3:
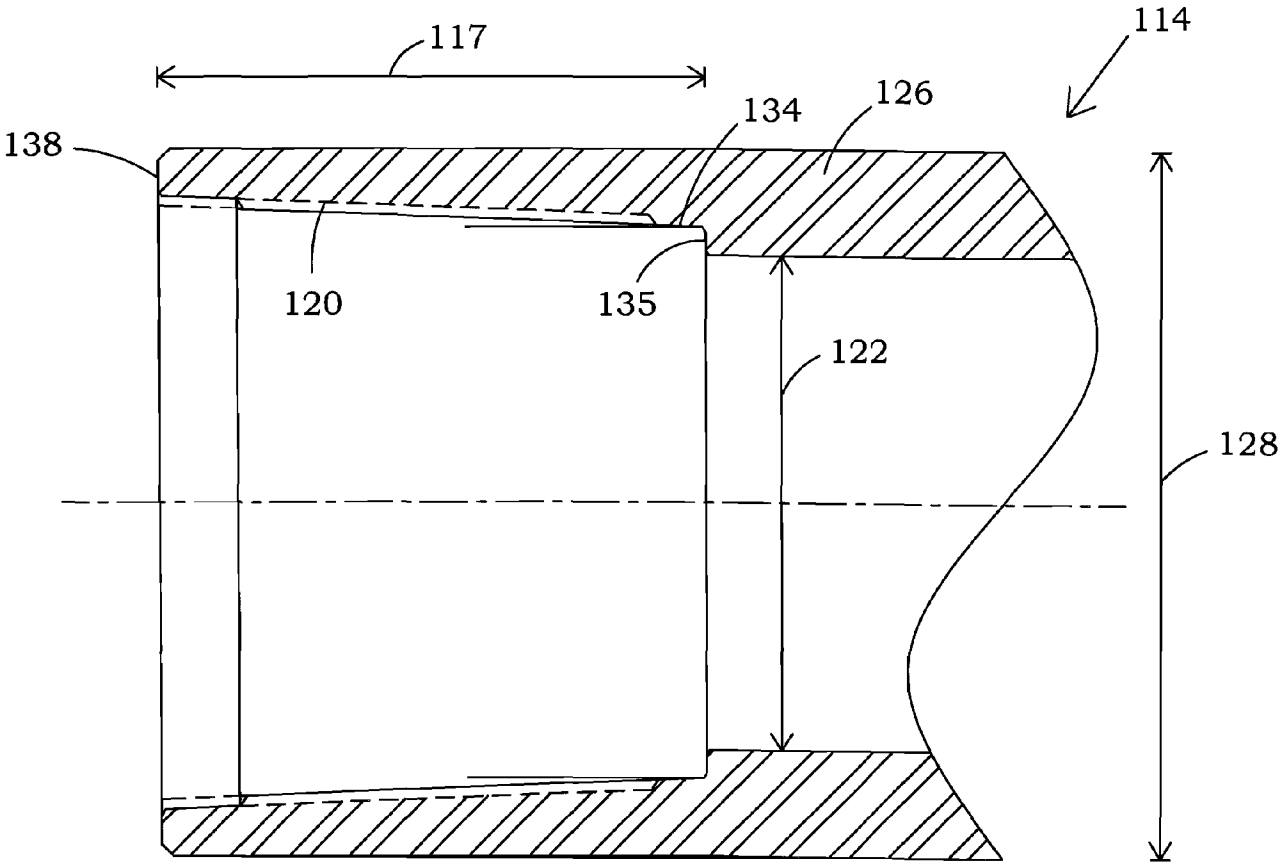
FIG. 3 is an elevational view, in cross-section, showing an enlarged end of a drill string connector with inner diameter, outer diameter, pin length and tapered threads in accord with one possible embodiment of the invention.

FIG. 2 and FIG. 3 show enlarged end views of pin connector 112 and box connector 114, respectively, for drill pipe 100A and 100B in accord with one embodiment of the present invention. Pin axial length 116 (see FIG. 2) and/or box axial length 117 (see FIG. 3) in accord with a presently preferred embodiment of the present invention may be (4.0) four inches (4.0") in length, or greater or lesser by about one quarter to one half inch.

A presently preferred taper of pin threads 118 and/or box threads 120 is 1.25 inches per foot. A preferred possible range of the taper of pin threads 118 and/or box threads 120 is 1.0 to 1.5 inches per foot. The limited taper, and the construction of the pin connector 112 and box connector 114 provides a strong connector that allows for a large internal diameter. The taper may be variable or continuous. The taper may be the variation in the radial position of some point on the threads with respect to axial length. The taper of both pin threads 118 and box threads 120 may typically be the same, but there may be some variations between the two.

As discussed in more detail hereinafter, the torsional strength and tensile strength exceeds the limits of any other existing coring pipe operable for coring in 7⅞ inch (7.875") to 8 inch bore holes with an inner diameter greater than or equal to four and three eighths inches.

More specifically, pin connector 112 and box connector 114 comprise upset 124 and 126, respectively, wherein each comprise minimum upset inner diameter 122 and, in an embodiment for drilling 7⅞ inch to 8" holes, also comprise a maximum upset outer diameter 128.

In one presently preferred embodiment, maximum upset outer diameter 128 is six and nine-sixteenth inches (6 9/16") or greater. Minimum upset inner diameter 122 is at least four and one half inches (4.5"). For drilling holes of seven and seven eighths inches (7⅞") or eight inches (8.0"), the maximum outer diameter is 6 9/16", or the maximum fishing grapple size which can be utilized through 7⅞" or 8.0" pipe.

However, in another embodiment, minimum upset outer diameter could also be six and one-quarter inches or greater and still comprise sufficient torsional strength for good coring operation. To the extent the connectors 112 and 114 are utilized in larger well bores, the outer diameter is preferably limited to the size of the maximum fishing grapple for those pipe sizes.

The thickness of one possible presently preferred embodiment of the upset results in a connection with a high torque torsional yield of at least 48,000 ft-lbs and a make-up torque of 28,000 ft-lbs or more. The combination of high torsional yield and large upset internal diameter, in one possible embodiment, of at least four and one-half inches, is used to receive larger core sample diameters, e.g., three and one-half inches in diameter cores, which can be cut at a length of about ninety feet in a single wireline run.

Pin connector 112 comprises an unthreaded guide taper 132. Box connector 114 comprises a corresponding mating unthreaded receptacle 134. In a presently preferred embodiment, the axial length of guide taper 132 and tapered receptacle 134 is one-half inches plus or minus a range of one-quarter to one-half inch.

In one presently preferred embodiment, nose 133 of taper 132 has an outer diameter which corresponds to internal shoulder 135 in box connector 14. The surface of nose 133 and shoulder 135, in one possible preferred embodiment, is perpendicular to the axis through the connectors.

Shoulder 136 and face 138 are provided on pin connector 112 and box connector 114, respectively. In one embodiment, preferably cylindrical surface 140 on pin connector 112, between shoulder 136 and the flank of the first thread of threads 118, is less than or equal to three-eighths inches (0.375") plus or minus one one-quarter inch.

In a preferred embodiment, tube or center portion 130 (see FIG. 4A and FIG. 4B) of drill pipe 100A and 100B may preferably have an outer diameter of at least five and one-half inches, but this outer diameter may be larger and/or continuous or variable. Tube 130 preferably has a minimum internal diameter of 4.778 inches within a range of plus or minus one-quarter to one-half inches.

Tube 130 may be welded or otherwise secured at opposite ends to pin connector 112 and box connector 114. In a preferred embodiment, the internal diameter of tube 130 is constant until reaching the ends thereof to permit easier movement of the core tool within the pipe. The outer diameter may or may not be constant, spiraled, or the like. Tube 130 may have a collapse pressure of 7,500 psi, and a pressure capacity of 14,500 psi.

The walls of tube 130 preferably have sufficient thickness to provide a tensile strength (axially directed force) of at least 620,600 lbs, which is less than the tensile strength of connectors 112 and 114, so that tube 130 tensile strength is the limiting factor for the overall pipe 100A or 100B tensile strength. It will also be noted that the wall thickness of tube 130 provides a torsional yield (rotationally directed force), for tube 130 exceeds that of connectors 112 and 114, so that the connection torsional yield of about 48,000 ft-lbs is the limiting factor for the overall pipe 100A or 100B torsional yield. The five and one-half inch pipe of tube 130 is also capable of drilling directional wells and wells that exceed 7,000 ft in depth and may be utilized up to 20,000 ft or more in highly angled holes. The connectors 112 and 114 may also be utilized under these conditions.

Drill pipe 100A and 100B each comprise an upper upset portion 126 for box connector 114 and a lower upset portion 124 for pin connector 112. An upper upset portion typically has an increased wall thickness as compared to the wall thickness of the center portion 130 that extends over most of the drill pipe joint 100A and 100B. Drill pipe joints 100A and 100B are typically about thirty feet in length.

In the embodiment of drill pipe 1008, only inner upset portions are provided at 142B and 143B, adjacent to the ends of tube 130, closest to the interconnection between the drill pipe and connectors. This may be a region where the wall thickness of tube 130 is increased prior to welding to joints 112 and 114 to provide a better footing for the weld. In the embodiment of drill pipe 100A, both inner and outer upset portions are provided at corresponding positions 142A and 143A. Thus, a stepped increase in connector thickness due to outer upset region 144 and 145 is shown in drill pipe 100A. The upset regions of 146 and 147 do not show this increase on the exterior of the connectors. The embodiment of 100A provides the advantage of somewhat greater torsional strength, but the embodiment of 100B provides more surface area at lifting surface 148 for the elevators of the rig to engage and lift the pipe string at the connectors and is a presently preferred embodiment for this reason. In this embodiment, lifting surface 148 on box connector 114 and the corresponding lifting surface on pin connector 112 (to the extent surface might be used for this purpose) may preferably have an upset outer equal to upset maximum outer diameter 128 and a lifting surface minimum outer diameter equal to an outer diameter of tube 130, thereby maximizing the radial difference of this surface for better engagement by the elevators of the rig.

In one possible embodiment, connector 114 has a length of 14 7/16 inches from the maximum diameter end of engagement surface 148 to the end of the pipe, which may vary in a range of up to about one-half foot. A corresponding length, which includes the length of the pin as indicated at 151, may be 19 7/16 inches with possible variations of about the same amount.

Figure 5:
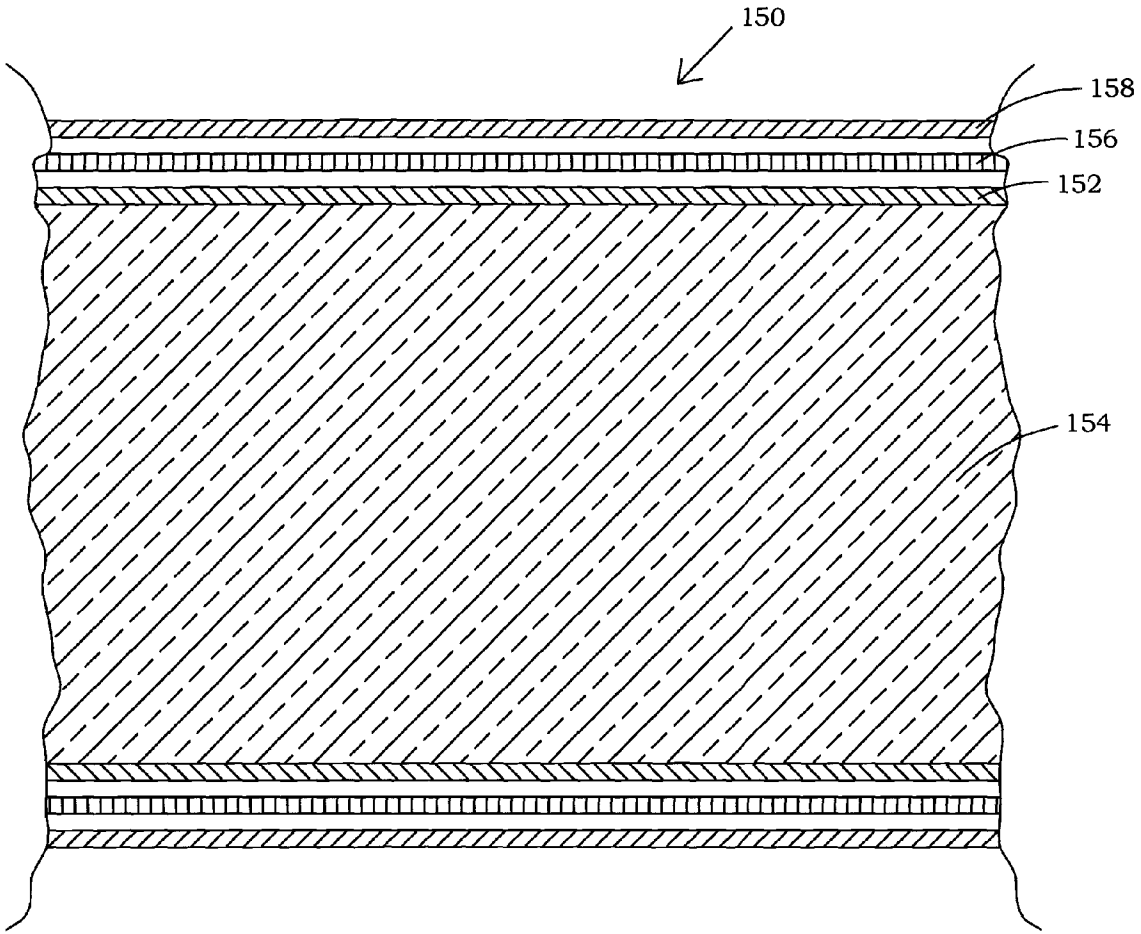
FIG. 5 is an enlarged elevational view, in cross-section, showing a core barrel with inner and outer steel tubes and an aluminum liner, in accord with one possible embodiment of the present invention.

FIG. 5 shows a more detailed sectional view of core barrel 150 in accord with one possible embodiment of the present invention, which may be utilized within core barrel 30 shown in FIG. 1. In this embodiment, aluminum liner 152 is utilized to support core 154. Steel inner tube 156 and steel outer tube 158 surround aluminum liner 152. The spacing between the various tubes may be less than or varied as desired. In one embodiment, the outer diameter of steel outer tube 158 is 4.4 inches. This core tool design feature provides sufficient support for the forces acting on the aluminum liner 152 to protect the core and achieve a 3.5 inch core up to 90 feet long. The robust durable inner tubes enable 3.5" wireline core to be cut in high pressure environments at long lengths. In another embodiment, a robust thick walled aluminum tube (3.625" ID×4.25" OD) may be utilized without the one or more optional steel tubes.

In accord with an embodiment of the present invention, coring tool 14 may have an outer core barrel with a large exterior diameter of, for instance, 4.4 inches. Accordingly, this outer core barrel will fit through the minimum inner diameter of 4.5 inches of connectors 112 and 114. In accord with one possible embodiment of the present invention, to provide the necessary pipe strength, it is desirable for the outer diameter for both the box and pin upset portions to be at least six and one-half inches (6½") for the purposes of drilling a seven to eight inch hole diameter size and less than or equal to six and nine-sixteenth inches (6 9/16").

Thus, in accord with the present invention, a five and one-half inch outer diameter drill pipe string 12 (with pipes such as 100A and 100B) is built as discussed above for the drilling string. The well is drilled to core point and the BHA drilling assembly is laid down. Outer core barrel 36 and core bit 44 is picked up and ran into the well bore 16. Once bottom is found and the hole is circulated bottoms up, the kelly (not shown) is racked back exposing the open drill pipe. Then complete inner coring assembly 14, which includes the tool seal seat 26, inner tube 30, and the other inner core assembly components, is picked up and dropped through the top of drill string 12. The assembly may fall at approximately three feet/sec or can be pumped in place if flow rates are below 100 GPM. Once inner coring assembly 14 is seated in shoulder 38, there is a significant pressure increase in the fluid indicating that the tool is hydraulically latched (held in position by hydraulic pressure). Coring commences. While coring, the fluid pressure of the drilling fluid should remain constant for a constant flow in gallon per minute within about plus or minus five percent, unless the formation core jams in inner assembly 14. Since inner assembly 14 is preferably held in place by hydrostatic pressure of drilling fluid being pumped through the tool, there may be insufficient force to hold the assembly in place. As a result, if inner assembly 14 is unseated, a significant pressure decrease is visible at the surface. The kelly may then be racked back and flow diverter 18 attached to the top of the drill string 12. Flow diverter sub 18 diverts drilling fluid to the mud tanks that is swabbed as a result of pulling coring assembly 14 through the drilling string. The coring tool assembly 14 is laid out on the catwalk and a second inner coring assembly 14 may be picked up and dropped down the string. This is a cyclical procedure that is repeated until the entire zone of interest is cored. After coring, then normal drilling can commence using the same drill string 12. Alternatively, the coring drill string 12 with dimension described above can be laid down and another drill string picked up, if desired. A standard API drilling rig will be able to handle standard drill pipe or drill pipes such as 100A and 100B as discussed above with little or no changes.

Coring/drilling/wellbore system 10 in accord with the present invention provides a tool that will cut a three and one-half inch diameter core up to ninety feet in length in a seven and three-quarter to eight inch diameter hole size. Drill pipe as discussed herein may be utilized in a wellbore up to at least 22,000 ft on a conventional drilling rig and using conventional drilling practices. Coring/drilling/wellbore system 10 may be used not only for coring but for drilling without coring and/or other drilling operations or wellbore operations where a large inner diameter drilling string is required that is operable with standard API drilling string couplings.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quick understanding or explanation of the invention. As well, the relative size and arrangement of the components may be greatly different from that shown and still operate well within the spirit of the invention as described herein before and in the appended claims. It will be seen that various changes in alternatives maybe used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and the components maybe oriented differently, for instance, during transpiration and manufacturing as well as operation. Because many varying and different embodiments maybe made, within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. An assembly operable for use in drilling a seven and seven-eighths to eight inch borehole at depths greater than 7000 feet, said assembly comprising:

a drill pipe tubular, said drill pipe tubular comprising a tube with a tubular outer diameter;

a pin connector and a box connector positioned on opposite ends of said tube, said pin connector comprising a threaded pin and said box connector comprising a threaded box;

said pin connector comprising an upset portion which comprises an upset outer diameter equal to or greater than six and one-quarter inches and less than or equal to six and three-quarter inches, said upset portion comprising an inner diameter of at least four and three-eighths inches, and wherein said threaded pin connection comprises a taper per foot of between one inch per foot and one and one-half inches per foot.

2. The assembly of claim 1, further comprising a lifting surface, said lifting surface comprising a minimum diameter equal to said tubular outer diameter.

3. The assembly of claim 1, wherein said threaded pin comprises a maximum axial length of four inches and said threaded pin comprises a non-threaded conical end portion.

4. The assembly of claim 1, further comprising:

a coring tool insertable into said drill pipe tubular, and an inner core barrel of said coring tool for receiving a core sample which is retrievable through said drill pipe tubular, said inner core barrel comprising an inner diameter equal to or greater than three and five-eighths inches.

5. The assembly of claim 4 wherein said inner core barrel has an outer diameter equal to or greater than four and one-quarter inches.

6. The assembly of claim 4 wherein said inner core barrel comprises an outer steel tube, an inner steel tube, and a liner.

7. The assembly of claim 1, further comprising:

a plurality of said drill pipe tubulars threadably connected together to form a drilling string, a wall thickness of said tube being sufficient such that said tube comprises a greater torsional strength than said pin connector and said box connector whereby said drilling string has a maximum torque without damaging said drilling string of greater than 48,000 foot pounds.

8. The assembly of claim 7, wherein said wall thickness of said tube being such that said tube has less tensile strength than said pin connector and said box connector, whereby said drilling string has a maximum tensile value without damaging said drilling string of greater than 786,000 pounds.

9. A method for drilling a seven and seven-eighths to eight inch borehole at depths greater than 7000 feet, comprising:

providing a drill pipe tubular with a tube with a pin connector on one end and a box connector on an opposite end;

providing said drill pipe tubular having a minimum inner diameter equal to or greater than four and three-eighths inches;

providing an upset for said pin connector and said box connectors, which has a maximum outer diameter equal to or less than six and nine-sixteenth inches;

providing a threaded pin for said pin connector and a threaded box for said box connector;

and providing said threaded pin and said threaded box with a taper per foot of between one inch per foot and one and one-half inches per foot.

10. The method of claim 9, further comprising providing that said threaded pin has a maximum axial length of four inches.

11. The method of claim 9, further comprising:

providing a coring tool comprising an inner core barrel operable for receiving a core and being positionable within an outer core barrel, said inner core barrel comprising a first tubular with an internal diameter greater than 3.5 inches, and a second tubular surrounding said first tubular.

12. The method of claim 11, further comprising providing a third tubular surrounding said second tubular.

13. The method of claim 12, wherein said third tubular comprises an outer diameter with a maximum outer diameter of up to 4.4".

14. The method of claim 13, further comprising providing that said inner core barrel length is sufficient for cutting up to 90 feet of core in one run.

15. A method for drilling a wellbore less than eight inches in diameter, comprising:

providing a plurality of drill pipe tubulars having a minimum inner diameter equal to or greater than four and three-eighths inches;

providing an upset permanently affixed to each of said drill pipe tubulars such that an outer diameter of said upset is greater than an outer diameter of said plurality of tubulars; providing a wireline retrievable coring tool having an inner core barrel sized for receiving a core with an outer diameter equal to or greater than three and one-half inches; and providing a steel outer tube and a steel inner tube and a liner for said inner core barrel.

16. The method of claim 15, comprising providing that said inner core barrel length is up to ninety feet in length.

17. An assembly operable for drilling a wellbore less than or equal to eight inches in diameter at depths greater than 7000 feet, comprising:

a plurality of drill pipe tubulars threadably connectable together operable for drilling in said wellbore less than or equal to eight inches in diameter wherein each drill pipe tubular has a tubular outer diameter;

an upset for each of said drill pipe tubulars having a maximum outer diameter greater than said tubular outer diameter;

each drill pipe tubular having an inner diameter equal to or greater than four and one-half inches;

each drill pipe tubular comprising a pin connection with a pin threaded portion and an unthreaded guide at an end of said pin connection; and each drill pipe tubular comprising a box connection with a box threaded portion and an unthreaded receptacle within said box connection for receiving said unthreaded guide, said unthreaded guide comprising a guide radial thickness, said unthreaded receptacle comprising a receptacle radial thickness, said guide radial thickness corresponding to said receptacle radial thickness whereby said pin connection has a pin connection inner diameter equal to a box connection inner diameter adjacent to said unthreaded guide and said unthreaded receptacle.

18. The assembly of claim 17, further comprising;

said upset having said outer diameter less than or equal to six and nine-sixteenth inches, said pin connection further comprising a pin external shoulder on an opposite side of pin threaded portion from said unthreaded guide, said box connection further comprising a face that is engageable with said pin external shoulder.

19. The assembly of claim 18, further comprising:

said pin connection having an axial length of equal to or less than four inches in length, and an unthreaded cylindrical surface positioned adjacent said pin external shoulder.

20. The assembly of claim 18, further comprising a coring tool configured for cutting at least 60 foot cores of three and one half inches in diameter.

* * * * *